US006803890B1

(12) United States Patent
Velayudhan et al.

(10) Patent No.: US 6,803,890 B1
(45) Date of Patent: Oct. 12, 2004

(54) ELECTROLUMINESCENT (EL) WAVEFORM

(75) Inventors: Bala K. Velayudhan, Bangsar (MY); Carol Ann Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 89 days.

(21) Appl. No.: 09/783,025

(22) Filed: Feb. 15, 2001

Related U.S. Application Data

(63) Continuation-in-part of application No. 09/532,866, filed on Mar. 22, 2000, now abandoned.
(60) Provisional application No. 60/125,829, filed on Mar. 24, 1999.

(51) Int. Cl.[7] ..... G09G 3/30
(52) U.S. Cl. ..... 345/76; 345/77; 345/78
(58) Field of Search ..... 345/74.1, 75, 76, 345/77, 78, 79, 80; 349/33; 341/118, 140

(56) References Cited

U.S. PATENT DOCUMENTS

| | | | | | |
|---|---|---|---|---|---|
| 3,979,745 | A | * | 9/1976 | Bishop | 341/140 |
| 4,568,913 | A | * | 2/1986 | Evans | 341/118 |
| 4,634,934 | A | | 1/1987 | Tohda et al. | 315/169.3 |
| 4,975,691 | A | | 12/1990 | Lee | 340/781 |
| 5,311,169 | A | * | 5/1994 | Inada et al. | 345/77 |
| 5,325,107 | A | * | 6/1994 | Ogawa et al. | 345/79 |
| 5,489,918 | A | * | 2/1996 | Mosier | 345/89 |
| 5,550,557 | A | * | 8/1996 | Kapoor et al. | 345/76 |
| 5,627,556 | A | | 5/1997 | Kwon et al. | 345/76 |
| 5,659,329 | A | * | 8/1997 | Yamanobe et al. | 345/74.1 |
| 5,714,274 | A | | 2/1998 | Sugiura et al. | 428/690 |
| 5,786,797 | A | | 7/1998 | Kapoor et al. | 345/79 |
| 5,805,124 | A | | 9/1998 | Kapoor et al. | 345/76 |
| 5,812,104 | A | | 9/1998 | Kapoor et al. | 345/76 |
| 5,838,289 | A | | 11/1998 | Saito et al. | 345/79 |
| 5,847,516 | A | | 12/1998 | Kishita et al. | 315/169.3 |
| 5,931,960 | A | * | 8/1999 | Kletter et al. | 714/704 |
| 6,094,243 | A | * | 7/2000 | Yasunishi | 349/33 |
| 6,104,367 | A | | 8/2000 | McKnight | 345/94 |
| 6,119,482 | A | * | 9/2000 | Bianchi et al. | 349/33 |
| 6,417,825 | B1 | * | 7/2002 | Stewart et al. | 345/77 |

FOREIGN PATENT DOCUMENTS

| | | | | |
|---|---|---|---|---|
| JP | 03-157690 | * | 5/1991 | 345/77 |

* cited by examiner

*Primary Examiner*—Vijay Shankar
*Assistant Examiner*—Prabodh M. Dharia
(74) *Attorney, Agent, or Firm*—Donald K. Wedding; Jim Zegeer

(57) ABSTRACT

A system and method including a waveform for addressing and achieving gray scale in an electroluminescent (EL) display.

6 Claims, 8 Drawing Sheets

| Condition | $M_1$ | $m_2$ | ... | $m_n$ | Gray level |
|---|---|---|---|---|---|
| none selected | | | | | Black |
| $m_1$ selected | | | | | Light proportional to $m_1$ |
| $m_1 + m_2$ selected | | | | | Light proportional to $m_1 + m_2$ |
| $m_1 + m_n$ selected | | | | | Light proportional to $m_1 + m_n$ |
| all selected | | | | | Full light output of pulse |

ELECTROLUMINESCENT (EL) WAVEFORM

RELATED APPLICATIONS

This is a continuation under 35 USC 120 of a U.S. patent application Ser. No. 09/532,866 filed Mar. 22, 2000 now abandoned which claims priority under 35 USC 119(e) of Provisional Application 60/125,829 filed Mar. 24, 1999.

INTRODUCTION

This invention relates to a system and method including a waveform for addressing and achieving gray scale for an electroluminescent (EL) display. This method is suitable for high-information content EL displays, including high definition television (HDTV).

BACKGROUND

An electroluminescent (EL) display consists of a luminescent or phosphor material sandwiched between opposing arrays of electrodes. The luminescent or phosphor material is electroluminescent and emits light when the material is stimulated with an electric current from voltages applied to the opposing arrays of electrodes. The electrode arrays may be segmented for alpha-numeric characters or orthogonally arranged as opposing rows and columns to produce a dot matrix display. The voltage applied to the electrodes may be AC or DC. If the electrodes are embedded into the material as transistors or diodes, the EL display is called an active matrix EL.

The crossover of an opposing row electrode and opposing column electrode defines a cell or pixel. In a color EL display, three pixels (red, blue, green) define a picture element.

The luminance (sometimes called brightness) of each pixel is dependent upon the magnitude of the voltage applied across the particular row electrode and column electrode that defines the pixel.

The magnitude of the minimum voltage required across the pixel to cause the phosphor material to emit light is the threshold voltage.

RELATED PRIOR ART

Electroluminescent (EL) displays have been described in the prior art. The following prior art pertaining to EL displays is hereby incorporated by reference.

U.S. Pat. No. 4,636,934 (Tohda et al)
U.S. Pat. No. 5,550,557 (Kapoor et al)
U.S. Pat. No. 5,627,556 (Kwon et al)
U.S. Pat. No. 5,714,274 (Sugiura et al)
U.S. Pat. No. 5,805,124 (Kapoor et al)
U.S. Pat. No. 5,812,104 (Kapoor et al)
U.S. Pat. No. 5,838,289 (Saito et al)
U.S. Pat. No. 5,847,516 (Kishita et al)
U.S. Pat. No. 5,786,797 (Kapoor et al)
U.S. Pat. No. 4,975,691 (Lee)
U.S. Pat. No. 6,104,367 (McKnight)

SUMMARY OF INVENTION

This invention relates to a dot matrix EL display with opposing arrays of electrodes arranged as rows and columns.

This invention particularly relates to providing gray scale in an alternating current (AC) electroluminescent (EL) dot-matrix display consisting of luminescent or phosphor material sandwiched between opposing arrays of electrodes, the electrodes of each array being orthogonal to the electrodes in the opposing array so as to provide opposing electrode rows and electrode columns. When AC voltages are applied to the opposing electrode rows and electrode columns, the luminescent or phosphor material is stimulated with an electric current and light is emitted.

This invention has advantages over the traditional method of achieving gray scale in an electroluminescent display, which include:

- This invention allows for a large number of gray scales at video refresh rate
- This invention allows for the use of the "on-off" EL cell state and easy implementation of column electrode drive circuitry. In the prior art, on off-set voltage (positive or negative) is required on the column drive circuitry. In this invention, a ground state is used to turn on a pixel to save up to 60% of the switching power.
- This invention allows for use of conventional integrated circuit (IC) drivers containing no gray scale intelligence. In the prior art, EL manufacturers have used IC drivers with gray scale intelligence built into the IC driver. These IC drivers are limited to six bits or less of gray scale and have limited current capacity not suitable for large area EL displays.
- This invention combines both voltage amplitude and voltage time modulation in a single waveform. The prior art uses one or the other, but not both.
- This invention makes use of a symmetric scan voltage to avoid the problem with EL display panel that it often suffers from latent imaging and pseudo persistence problems which cause smearing and ghost image on the display panel. This is a result of the pixel's voltage-time average being non-zero when averaged over several scans through the panel.

This invention relates to:

1. A system and method for driving an EL display and providing gray scale comprising a generator for generating and applying a voltage waveform to the row electrodes and column electrodes comprising:
   (a) At least one Positive Ramped Modulating Pulse with a gradually sloped portion divided into n weighted divisions of 'm' sloped that are uniquely selectable in time, and may be combined in a maximum of $2^n$ unique combinations of gray scale levels, and
   (b) Zero or more Positive Non-Ramped Modulating Pulses (flat plateau) that are not sloped
   These pulses, (a) and (b), when applied successively form a scan pulse, across an electrode row and an electrode column of an EL display to provide sufficient current for a sufficient time to cause the EL to emit bursts of light proportional to the current and integratable by the human eye into unique gray levels.
2. The inversion of these pulses (a) and (b) to form a Negative Ramped Modulating Pulse and a Negative Non-Ramped Modulating Pulse which negates the buildup of a voltage bias across the EL material caused by (a) and (b).
3. In the practice of this invention to provide gray scale, ramped modulation and non-ramped modulation voltages when gated by the column driver outputs will produce the luminance proportionate to the magnitude of the voltage applied across the particular row and column electrodes. Non selected columns will either have negative or positive cancellation voltage depending on the polarity of the scan. This invention also includes tri-stating the outputs of the unselected columns.

4. In this invention the voltage ramp exhibits a slope that is set to establish constant current flow through the phosphor for a given level of gray scale.

DETAILED DESCRIPTION OF THE DRAWINGS AND EMBODIMENT OF INVENTION

Reference is made to the drawings and FIGS. 1 to 8 thereon.

Figures 1, 2:
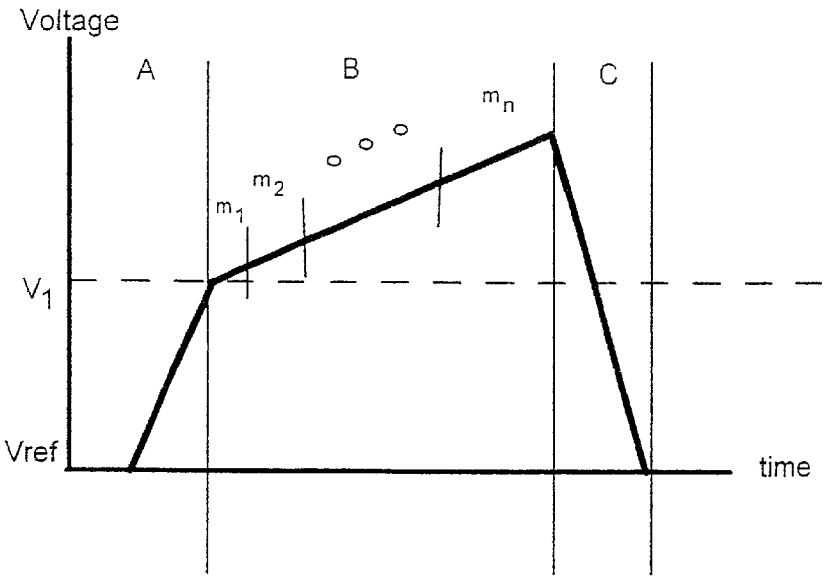
FIG. 1 shows a Positive Ramped Modulating Pulse.
FIG. 2 shows various waveform combinations to achieve gray scale.

FIG. 1 illustrates the Positive Ramped Modulating Pulse that consists of a gradually sloped portion 'B' with n weighted divisions, 'm', that are uniquely selectable. These 'm' divisions may be gated or selected in any combination to form a maximum of $2^n$ unique combinations. Section A is the voltage rise from $V_{ref}$ to $V_1$ $V_{ref}$ is a DC reference voltage of any arbitrary positive or negative value including ground. The difference between $V_1$ and $V_{ref}$ is the threshold voltage. $V_1$ is the minimum voltage necessary to cause the EL phosphor to emit light. Section 'C' is the fall time.

Figure 3:
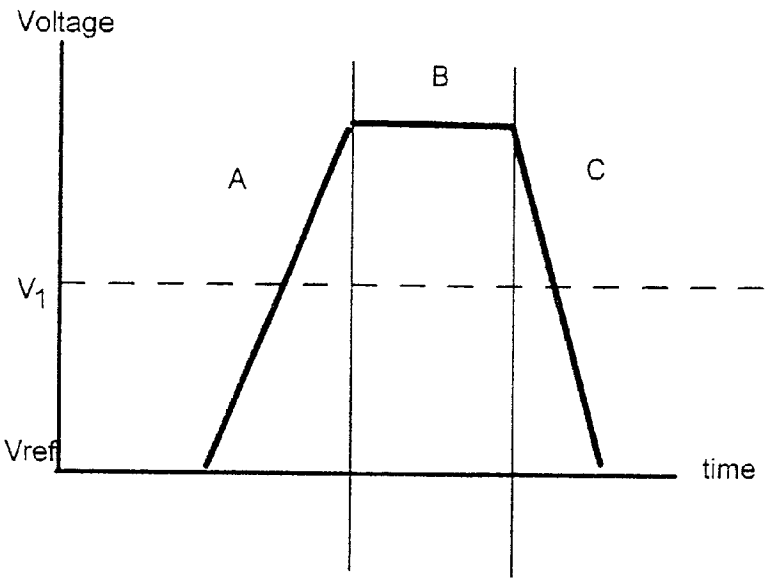
FIG. 3 shows a Positive Non-Ramped Modulating Pulse.

FIG. 2 illustrates the selection of the divisions $m_1$ through $m_n$ in various combinations. The summation of these divisions is proportional to current flow across the EL material. The resulting light output from the EL material is proportional to the current flow across the EL material. FIG. 3 illustrates the Positive Non-Ramped Modulating Pulse (flat plateau). Section 'A' is the rise time (with $V_1-V_{ref}$ equaling the threshold voltage) and section 'C' is the fall time and section 'B' is the flat plateau. When this pulse is present, it produces light output from the EL material that is proportional to the current flow across the EL material.

Figures 4A, 4B:
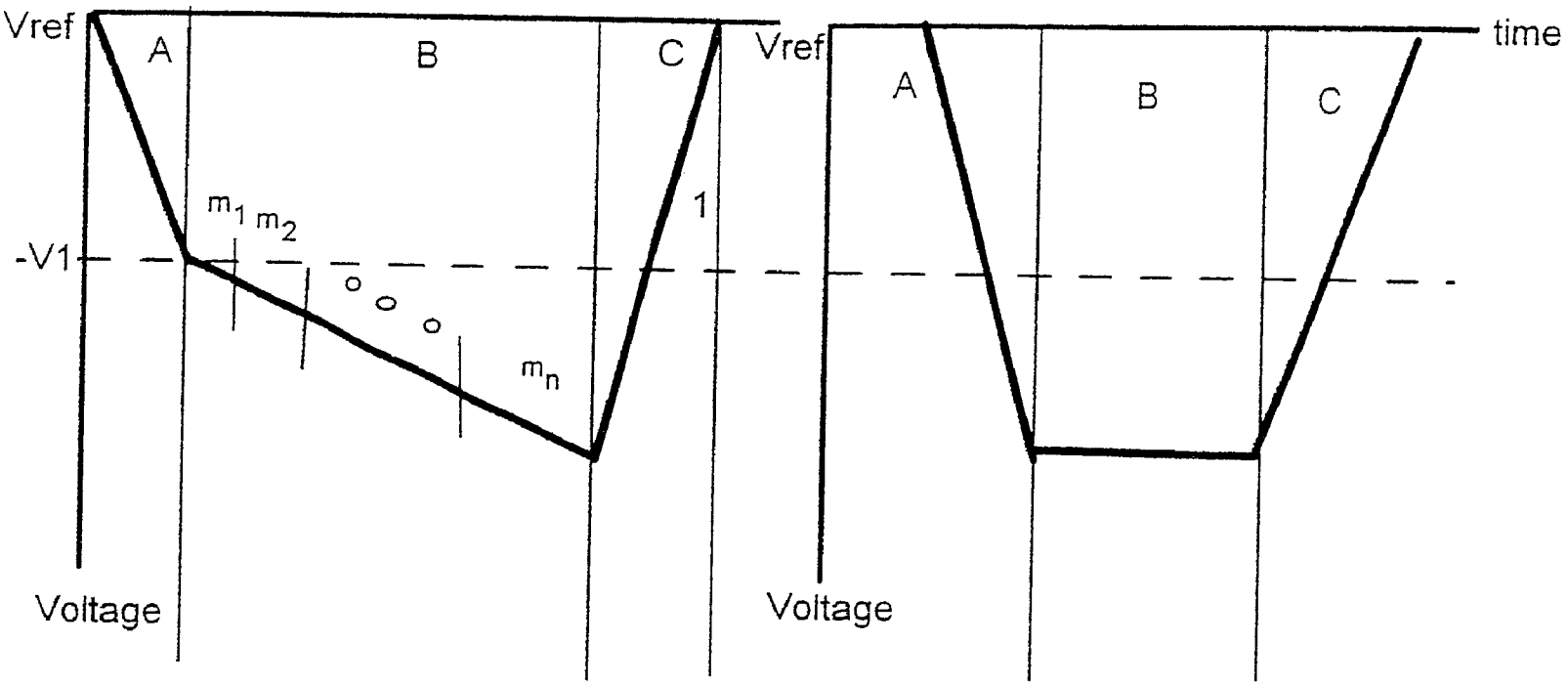
FIG. 4*a* shows a Negative Ramped Modulating Pulse.
FIG. 4*b* shows a Negative Non-Ramped Modulating Pulse.

FIG. 4 consists of FIGS. 4*a* and 4*b*. FIG. 4*a* illustrates a Negative Ramped Modulating Pulse to eliminate substrate bias (voltage bias across the EL material) caused by the Positive Ramped Modulating Pulse of FIG. 1. The illustration shows a pulse that is identical to the pulse of FIG. 1 except that it is inverted with respect to $V_{ref}$ and has equal and opposite features. In fact, this pulse can be of any shape and duration as long as its characteristics are sufficient to cancel the substrate bias at the cell caused by the pulse of FIG. 1.

FIG. 4*b* illustrate a Negative Non-Ramped Modulating Pulse used to eliminate substrate bias for the Positive Non-Ramped Modulating Pulse shown in FIG. 3. The illustration shows a pulse that is identical to the pulse of FIG. 3 except that it is flipped vertically (e.g. inverted) and has equal and opposite features. In fact, this pulse can be of any shape and duration so long as its characteristics are sufficient to cancel the substrate bias at the cell caused by the pulse of FIG. 3.

Figure 5A:
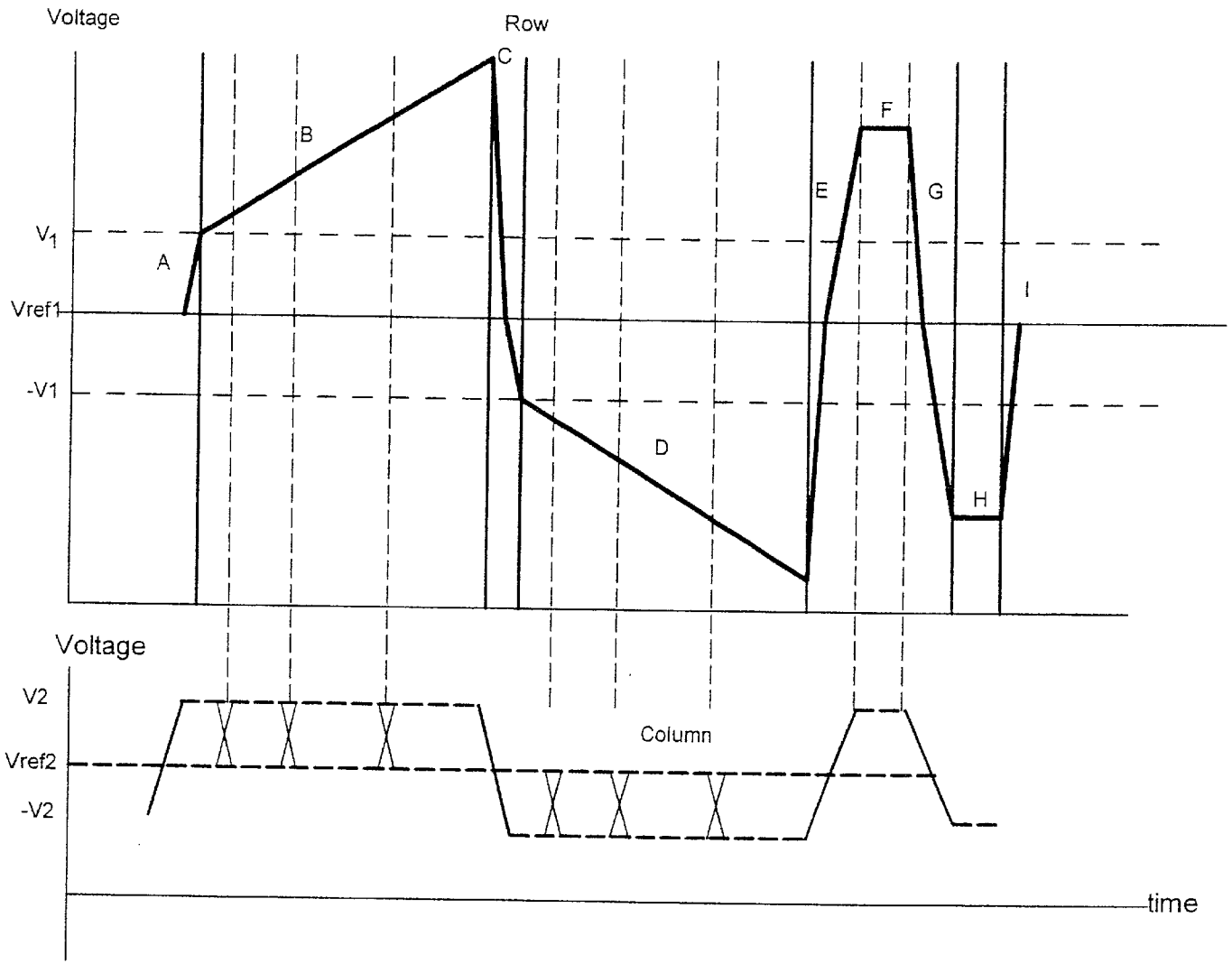
FIG. 5*a* shows waveforms that embody this invention.
Figure 5B:
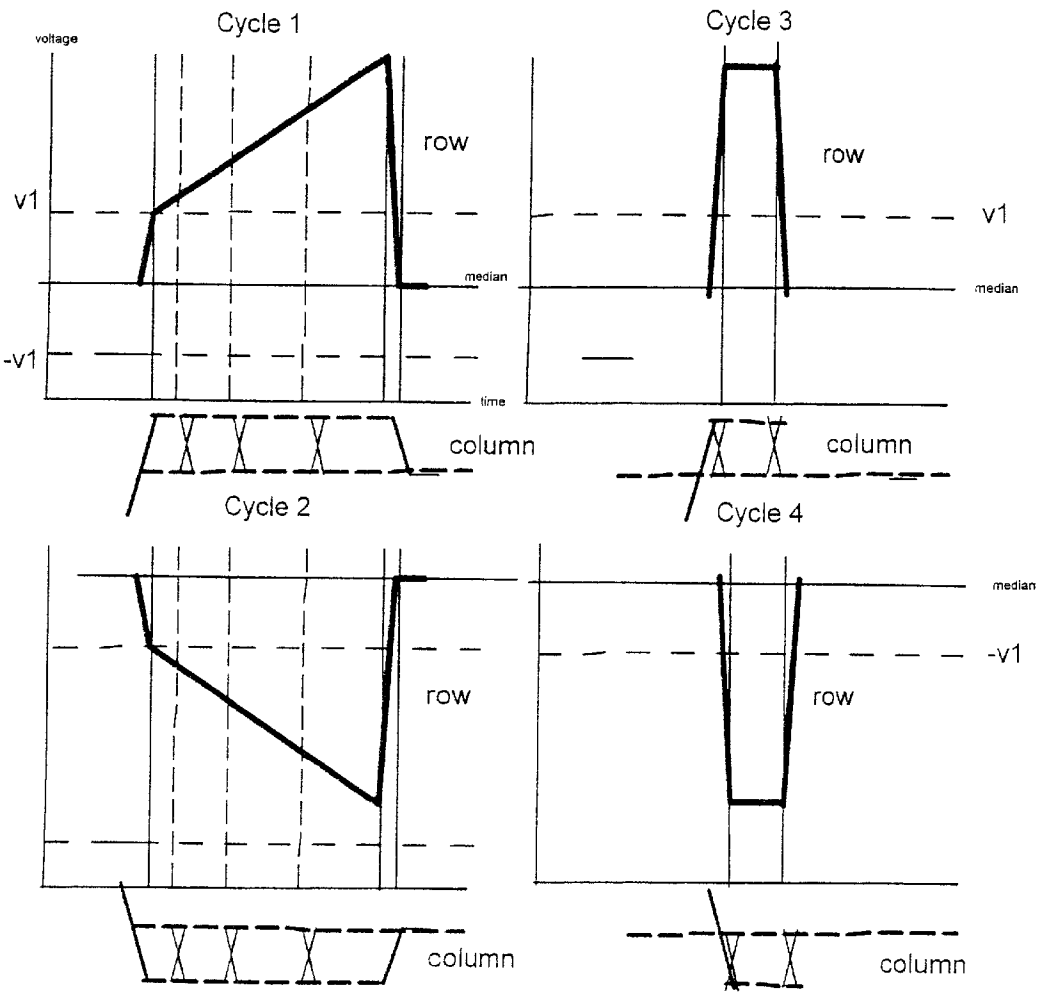
FIG. 5*b* shows further waveforms that embody this invention.

FIGS. 5*a* and 5*b* both illustrates waveforms that embody this concept.

In FIG. 5*a*, the waveform consists of one Positive Ramped Modulating Pulse followed by a Negative Ramped Modulating Pulse, and one Positive Non-Ramped Modulating Pulse followed by a Negative Non-Ramped Modulating Pulse. In the actual application of the waveform to a particular EL display, there may be multiples of either or both in any order or combination to achieve the desired gray scale level and refresh rate.

In this case of FIG. 5*a*, both the positive and negative modulating pulses are activated on a given row electrode. The column electrode is used to gate the appropriate gray scale level for a given cell. Voltage present on the column electrode is shown on the lower part of the diagram. The voltage on the column electrode can be V2, −V2, or Vref2. These voltages are indicated by dotted lines. Transitions between these voltages are indicated with an 'X'.

Section A of FIG. 5*a* shows the start of the waveform. The voltage on the row is raised to $V_1$ the threshold Voltage.

Section B shows the Positive-Ramped Modulating Pulse of the waveform. In this section the voltage on the row electrode is slowly raised. The rate of the increase, or rise time, is determined by the properties and characteristics of the EL material. When the column electrode voltage is at Vref, the potential across the EL material is greater than the threshold voltage of the EL material and current is allowed to flow across the EL cell and light is emitted. When the column electrode voltage is sufficiently high the potential across the EL material is below the threshold voltage and current is prevented from flowing across the cell and light is not emitted.

Section C is the transition to the Negative Ramped Modulating Pulse.

Section D is the Negative Ramped Modulating Pulse. It negates the bias placed on the EL material by Section B. This is accomplished by providing equal and opposite pulses on both the row and column electrodes. When the voltage on the column electrode is at Vref, the potential across the EL material is greater than the threshold voltage of the EL material and current is allowed to flow across the EL cell and light is emitted. When the voltage across the column electrode is sufficiently low, the potential across the EL material is below the threshold voltage and current is prevented from flowing across the cell and light is not emitted.

Section E is the transition to the Positive Non-Ramped Modulating Pulse.

Section F is the Positive Non-Ramped Modulating Pulse or flat plateau at a selected voltage level. In this case, the time duration for this voltage level is selected to produce the equivalent light output of the entire ramped pulse of Section B. This allows for increasing the number of gray scales in a given period of time. This pulse is also gated on or off with the column electrodes in the same manner as previously described.

Section G is the transition to the Negative Non-Ramped Modulating Pulse.

Section H is the Negative Non-Ramped Modulating Pulse. It negates the bias placed on the EL material by Section F. This is accomplished by providing equal and opposite pulses on both the row electrodes and column electrodes. This pulse is gated by voltage on the column electrode as previously explained.

Section I begins the cycle again on another row electrode.

FIG. 5*b* shows an alternate approach in which the waveform of FIG. 5*a* is divided into Cycles. Each Cycle is applied one row at a time to one or more rows. Each pair of Cycles contributes unique gray scale information. The Cycles are summed to get complete gray scale information. This approach promotes power savings by reducing the number of transitions on the row electrodes.

In the bottom column portion of FIGS. 5(*a*) and 5(*b*), the X's denote the rise time and fall time of column electrode cancellation voltages for a given gray level, i.e., form voltage V2 to Vref or from Vref to voltage V2. Dashed lines denote when the said column electrode is held at Vref.

Figure 6:
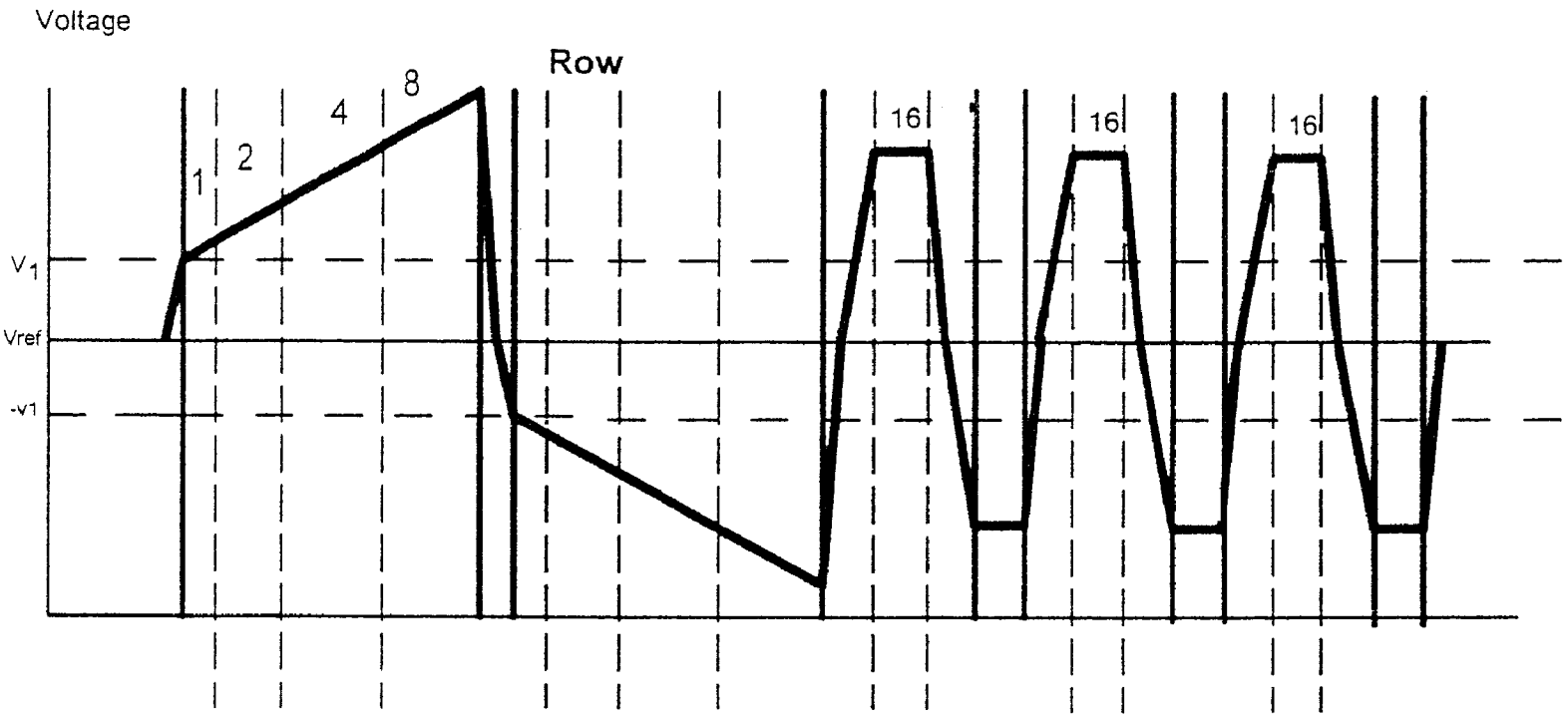
FIG. 6 shows further waveforms that embody this invention.

FIG. 6 is another example of the use of this waveform to achieve 64 levels of gray over 480 lines. In this example, Positive and Negative Ramped Modulating Pulse comprises the first four bits (or the lowest 16 unique gray levels). The three Positive and Negative Non-Ramped Modulating Pulses comprise the last two significant bits (or gray levels 32 and 64).

Figure 7:
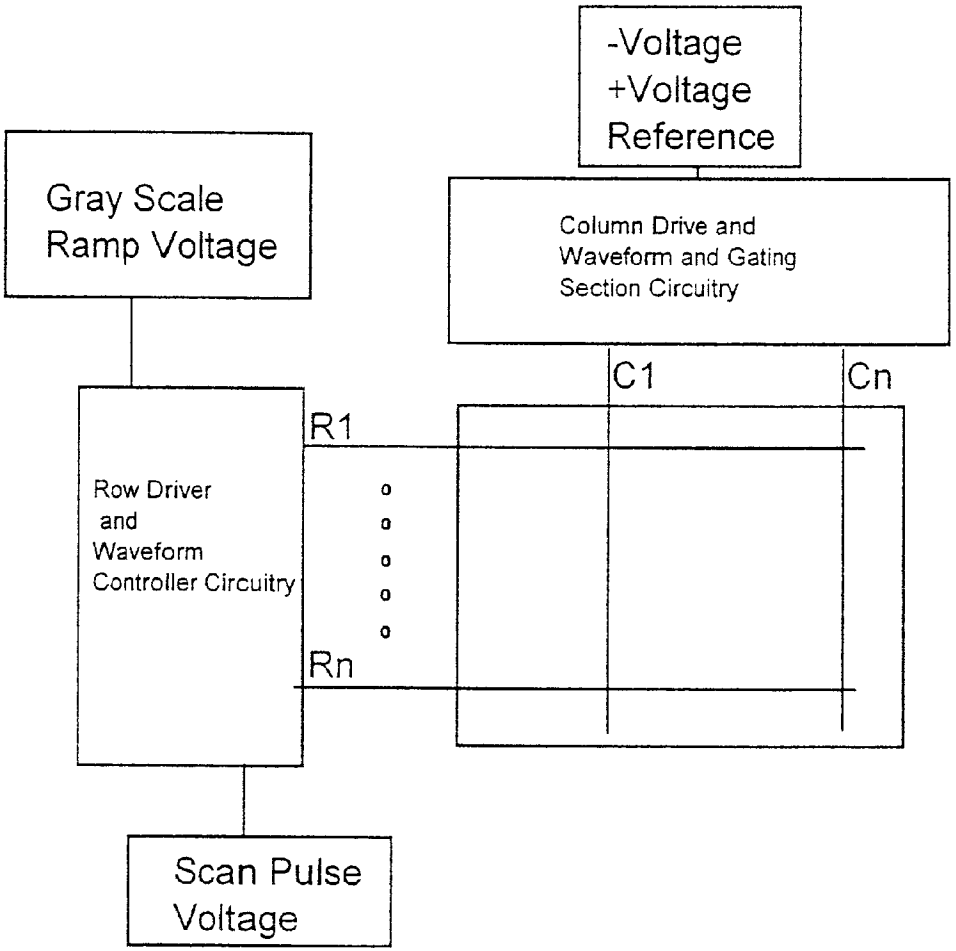
FIG. 7 is a block diagram of an EL display with electronic circuitry.

FIG. 7 is a block diagram of an EL display practicing this invention. R1 though Rn are the electrode rows. C1 through Cn are the electrode columns.

The Row Driver And Waveform Controller circuitry produce the waveform illustrated in FIGS. 1 through 6 on any row or combination of rows R1 through Rn in any order including progressive, interlaced. The Column Driver And Waveform and Gating Section circuitry independently control the gating of each electrode column and therefore produce independent gray scales on each of the electrode columns on a row by row basis.

One embodiment is to reference the row electrode drivers and the column electrode drivers on offset voltage equal to the positive and negative threshold voltage. This allows for greater flexibility of the driver output and drivers with lower voltage outputs may be used. The entire output range of the row drivers may be devoted toward the generation of the modulating slope.

In the case of the waveforms in FIGS. 5*a* and 5*b*, referencing the row electrode drivers on the positive and negative threshold voltage allows for power savings.

Global brightness may be controlled by changing the amplitude of the modulating pulses.

Figure 8:
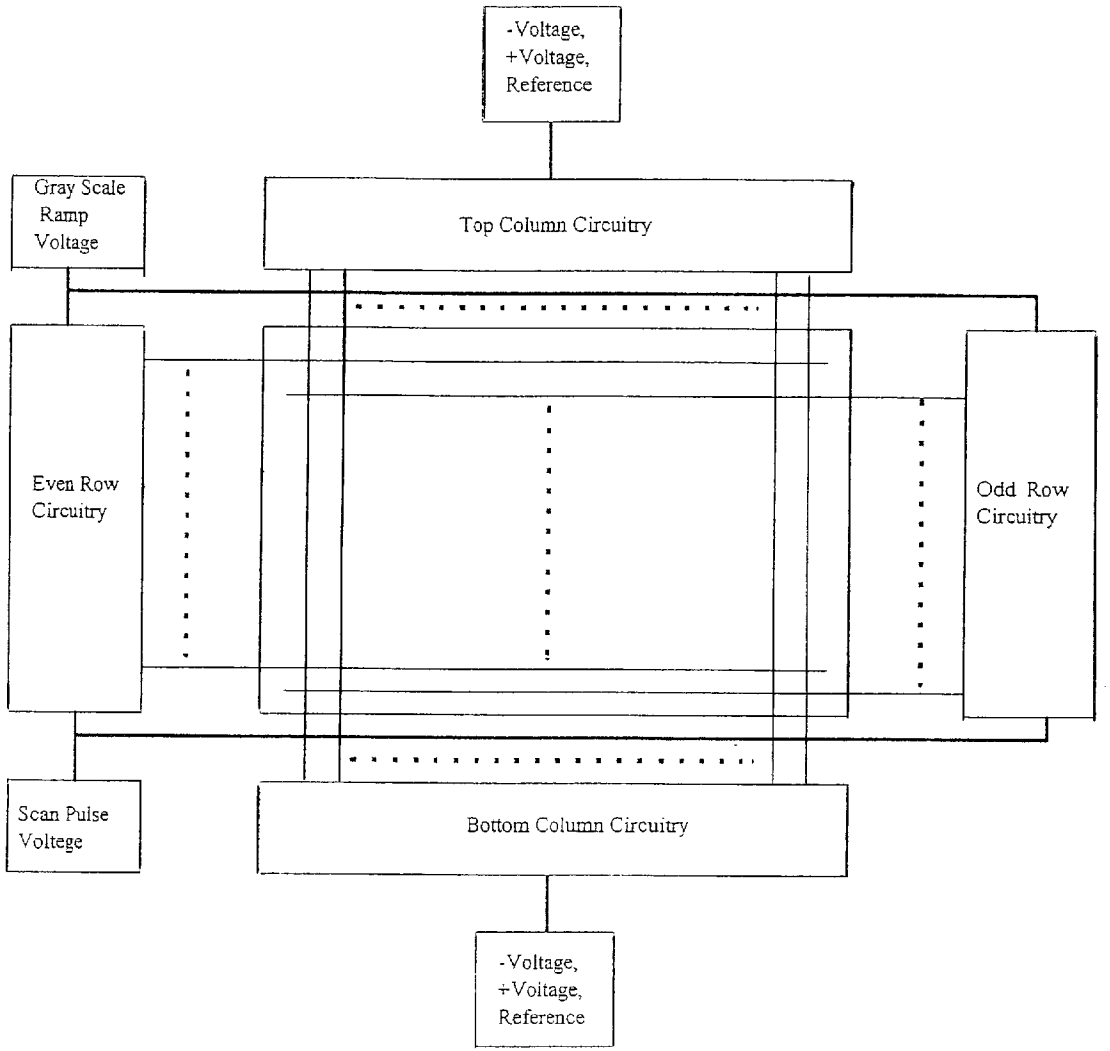
FIG. 8 is a block diagram of an EL display with electronic circuit.

FIG. 8 is a block diagram of another EL display embodiment for practicing this invention. As illustrated, the circuitry comprises opposite Even and Odd Row Circuitry and opposite Top and Bottom Column Circuitry. The Even and Odd Row Circuitry comprises Row Driver and Waveform Controller Circuitry. The Top and Bottom Column Circuitry comprises Column Driver and Waveform and Gating Section Circuitry. In this embodiment, the EL column electrodes from top to bottom are illustrated as broken in order to form a split screen.

The luminescent material or phosphor used in an EL display is typically an inorganic oxide or sulfide host doped with the same or another material. In a single color, monochrome EL display, the phosphor is a zinc sulfide host doped with manganese (ZnS:Mn) which emits a yellow color at an efficiency of 3 to 6 lumens per watt.

For a color EL, there will be three separate luminescent materials, one phosphor for each primary color—red, blue, and green. Examples of doped phosphors include CaS:Eu (red), SrS:Ce (blue-green), and ZnS:Tb (green). In addition, color filters may be used.

What is claimed is:

1. In a method for driving an EL display and providing gray scale, said EL display having opposing arrays of row and column electrodes, a layer of EL material sandwiched between the opposing row and column electrodes, the improvement which comprises: a weighted division method using cancellation pulses to produce gray scale by driving said row and column electrodes with a voltage waveform having at least one Positive Ramped Modulating Pulse (a) with a gradually sloped portion divided into n weighted divisions of 'm' sloped that are uniquely selectable in time by cancellation pulses, and selectively combined in a maximum of $2^n$ unique combinations of gray scale levels.

2. The invention of claim 1 wherein the voltage waveform comprises pulse (a) and at least one Positive Non-Ramped Modulating Pulse (b).

3. The invention of claims 2 wherever the pulses (a) and (b) are inverted to form a Negative Ramped Modulating Pulse and a Negative Non-Ramped Modulating Pulse to negate the buildup of a voltage bias across the EL material caused by pulses (a) and (b).

4. In a system for driving an EL display and providing gray scale, said EL display having opposing arrays of row and column electrodes, a layer of EL material sandwiched between the opposing row and column electrodes the improvement which comprises: a weighted division method using cancellation pulses to produce gray scale by driving said row and column electrodes with a voltage waveform having at least one Positive Ramped Modulating Pulse (a) with a gradually sloped portion divided into n weighted divisions of 'M' sloped that are uniquely selectable in time, by cancellation of pulses, and selectively combined in a maximum of $2^n$ unique combinations of gray scale levels.

5. The invention of claim 4 wherein the voltage waveform comprises pulse (a) and at least one Positive Non-Ramped Modulating Pulse (b).

6. The invention of claim 4 wherever the pulses (a) and (b) are inverted to form a Negative Ramped Modulating Pulse and a Negative Non-Ramped Modulating Pulse to negate the buildup of voltage bias across the EL material caused by pulses (a) and (b).

* * * * *